United States Patent [19]

Coppens

[11] 3,987,923

[45] Oct. 26, 1976

[54] PRESSURE CONTAINER

[75] Inventor: Matheus J. M. Coppens, Kalmthout, Belgium

[73] Assignee: Koninklijke Emballage Industrie Van Leer B.V., Amstelveen, Netherlands

[22] Filed: July 30, 1974

[21] Appl. No.: 493,060

[30] Foreign Application Priority Data

Aug. 14, 1973 Netherlands ..... 7311202

[52] U.S. Cl. ..... 220/3; 220/5 R; 220/69; 220/71

[51] Int. Cl.[2] ..... B65D 7/02; B65D 7/42

[58] Field of Search ..... 220/3, 5 A, 67, 69, 220/71, 76, 77, 78, 79, 5 R, 85 P

[56] References Cited

UNITED STATES PATENTS

| | | | |
|---|---|---|---|
| 397,047 | 1/1889 | Barrath | 220/69 |
| 1,237,151 | 8/1917 | Barnett | 220/69 |
| 2,739,732 | 3/1956 | Bogner | 220/67 |
| 2,829,793 | 4/1958 | Bauman | 220/5 A |
| 2,969,166 | 1/1961 | Henchest | 220/67 X |
| 3,525,455 | 8/1970 | Saunders | 220/67 |

*Primary Examiner*—William Price
*Assistant Examiner*—Steven M. Pollard
*Attorney, Agent, or Firm*—Stevens, Davis, Miller & Mosher

[57] ABSTRACT

A pressure container including a cylindrical sleeve portion and an outwardly domed end wall which is connected with the sleeve portion by a seam connection. A reinforcement ring is locked between an outwardly turned surface of the domed end wall and the seam connection and the end wall and seam connection lock the reinforcement ring axially and radially. The reinforcement ring may include a bead on one end of a cylindrical sheet metal element which protrudes axially from the end wall.

5 Claims, 8 Drawing Figures

PRESSURE CONTAINER

The invention refers to a pressure container consisting of a cylindrical sleeve portion and at least one outwardly domed end piece which is connected with the sleeve portion by means of a seam connection. A similar container is known but, in practice, it is applied exclusively in the form of small pressure containers in which one of the domed parts is then mostly turned inward. Examples are aerosol packings and gas containers for camping purposes. With pressure containers having a relatively small diameter and, proportionally, a fairly large sheet gauge, the internal forces acting upon the end pieces may be sufficiently absorbed by means of the seam connections without the risk of the latter being opened by the forces that might occur.

With containers having a relatively large diameter it will be difficult to dominate the occurring forces and the measures then required in order to obtain a sufficiently strong seam connection will render the manufacture of such a container uneconomical, while in many cases the outcome will still be dubious. The risk that the seam connection will be opened by the internal pressure is greater if the domed end pieces are turned inward than if they are turned outward.

In practice, the result of this has been that larger containers, such as barrels for pressurized liquids, generally consist of a cylindrical central piece to which the domed end pieces are welded. If, however, such containers should be used for dangerous or sensitive substances, the commercial steel as used for such containers will not be suitable and the interior of the containers should be supplied with a coating insensible to the substances to be transported. The applying of such coating is extremely difficult and dubious if this should take place through the filling hole of the finished container. If, on the other hand, the coating is applied before the parts are welded together, the coating will be damaged. As a solution to this problem, containers made of aluminium or stainless steel are being used. Such containers are expensive and, therefore, justified only if they have a long-live time. As often as not, however, this is not the case due to rough handling during the transport. An example of such a large container is a beer-barrel. The invention aims at providing a container in which the seam connection can indeed resist the occurring forces, so that it will be possible to manufacture larger containers from plain materials and which can be easily coated beforehand while such containers will be proof against the occurring forces.

According to the invention, this object is achieved owing to insertion of a reinforcement ring between the said seam connection and the adjoining end piece material, which ring is axially and radially closed in by the end piece material. Such a reinforcement ring may be, for instance, a massive, in section circular ring of metal or solid plastic. According to the invention the reinforcement ring may also be formed by the thickened edge or bead of a cylindrical supporting ring protruding axially beyond the domed end piece. Supporting rings axially protruding beyond the domed end piece are known per se. They serve to simplify the rolling and raising of the container. In that case, they are secured to the container by means of welds.

Due to the reinforcement ring, respectively the thickened or beaded edge of the supporting ring being closed in by means of the folded seam according to the invention, the forces acting on the end pieces are not exercised directly and exclusively on the seam connection but only indirectly while, due to the inward shifting of the seam connection, axial shiftings of the end piece, eventually causing the unrolling of the seam connection, can occur only after the seam connection will have expanded.

According to the invention, the seam connection between sleeve portion and end piece may be an outwardly directed seam connection which has been shifted inwardly and radially in respect of the sleeve portion in such a manner that, essentially, the reinforcement ring is placed axially beside the seam connection. Any normal seam connection may be used between end piece and sleeve portion and the seam connection is being forced inwardly in such a manner as to close in the reinforcement ring. For that purpose, the end piece is supplied with a gutter-shaped part at the edge, the outer leg of which supports the flange or the part which is embodied in the seam connection. By a normal seam connection, respectively an outwardly turned seam connection is understood either a double or triple flattened seam connection or, in section, an essentially spiral seam connection.

Instead, it will also be possible to apply an inwardly turned seam connection obtained by axial deformation, in which the reinforcement ring, in the same manner as with the outwardly turned seam connection, may be closed in between the seam connection and the U-shaped part of the end piece edge or the bent edge of the supporting ring is embodied in the seam connection. In all these cases an enlargement of diameter will have to take place for the unrolling of the seam connection which will meet with resistance from the ring formed by the seam connection and the reinforcement ring; from the seam connection because this would require a larger diameter and should, therefore, be stretched, and from the reinforcement ring because this will resist the inward shifting.

The invention will now be further illustrated by means of the drawings.

Figure 6:
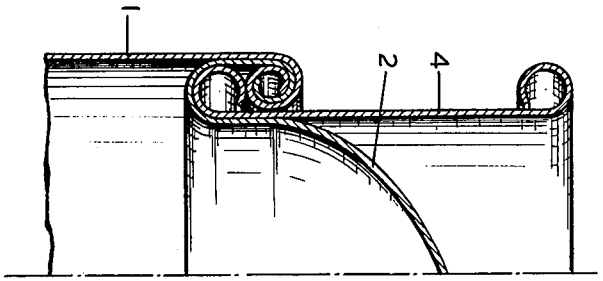
Figure 7:
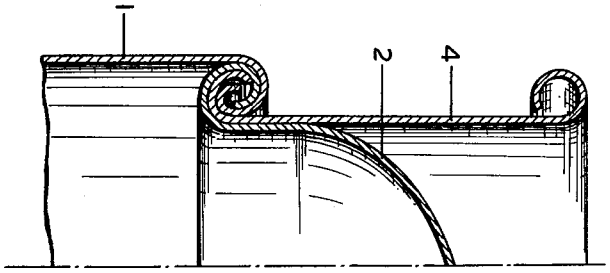

FIGS. 6 and 7 refer to variants of the connection.

Figure 8:
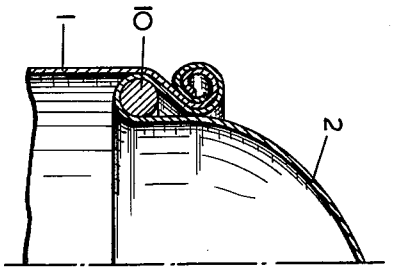

FIG. 8 shows yet another variant.

Figure 1:
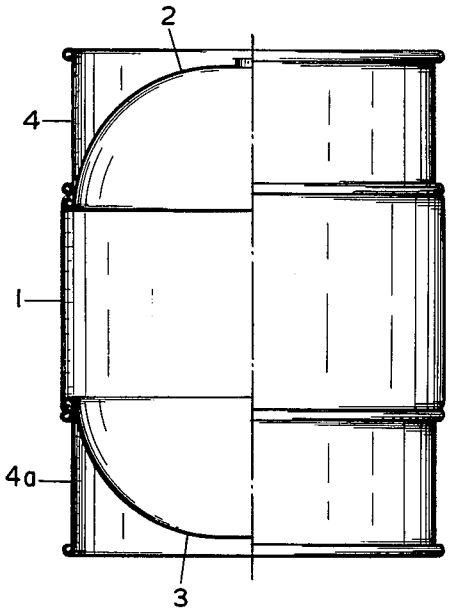
FIG. 1 shows a container according to the invention, partly in view and partly in section.

The container represented in FIG. 1 consists of a cylindrical sleeve portion 1 with two spherical end pieces 2 and 3 and two supporting rings 4 and 4*a*. The supporting rings 4 and 4*a* protrude axially from the end pieces 2 and 3 and may, therefore, serve as support, handle etc. in the usual manner.

Figure 2:
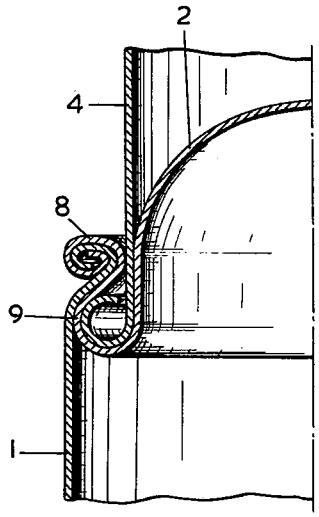
FIG. 2 shows, in section, the preferential embodiment of the connection between the sleeve end piece and the supporting ring serving as reinforcement ring.
Figure 3:
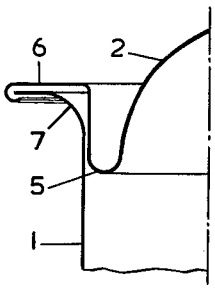
FIGS. 3, 4 and 5 show, in section, phases in the manufacture of the connection, the final form of which is given in FIG. 2.
Figure 4:
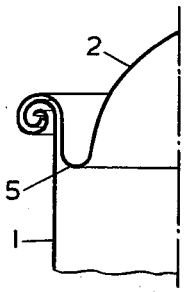
Figure 5:
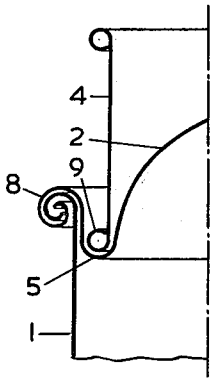

FIG. 2 shows the connection between sleeve portion 1, end piece 2 and supporting ring 4. This connection has been realized because, as shown in FIG. 3, the end piece 2 is supplied with a U-shaped part of the edge 5 between the proper domed part and the flange 6 which, together with the flange 7 of the sleeve 1, should form the seam connection. FIG. 4 shows this connection after manufacture and FIG. 5 shows the situation after the supporting ring 4 has been placed in the gutter-shaped part 5. When, after that, the seam connection 8 thus obtained is radially shifted further inward, as shown in FIG. 2, the beaded edge 9 of the ring 4 is axially and radially closed in between the seam connection 8 and the material of the end piece 2 encircling the bead 9, whereby the cylindrical part of the ring 4 is fixed between the bead 8 and the end piece 2. Sheets thus connected with each other may be previously supplied with a coating which is adaptable to the deformations. Instead of using the spiral folded seam as shown in FIGS. 2 up to 5 inclusive, it will also be possible to use ordinary double or triple folded seams.

In the embodiment as shown in FIG. 6 the edges of both sleeve portion and end piece are inwardly rolled around each other by means of an axial deformation known per se, whereby the edge of the supporting ring is closed in correspondingly as shown in FIG. 2.

In the embodiment as shown in FIG. 7 the seam connection is obtained in the same manner as in FIG. 6 but the lower edge of the supporting ring was beaded in the shape of an open gutter and the dimensions of the various parts were so chosen that, in rolling the sheet edges inward by means of dies or rollers acting in axial direction, the edge of the supporting ring is embodied in the seam connection.

In the embodiment according to FIG. 8 the reinforcement ring 10 consists of a massive ring which is completely closed in the material of the end piece 2. Such a massive or, eventually, a hollow ring may be applied in a similar manner in the seam connection as shown in FIG. 6.

I claim:

1. A pressure container comprising:

a cylindrical metal sleeve, an outwardly domed end wall, at least at one end of said sleeve, a seam connection between the outer end of said cylindrical metal sleeve and a flange of said outwardly domed end wall, said domed end wall extending axially away from the seam connection and having an outwardly turned surface, adjacent the seam connection, which extends substantially parallel to the cylindrical sleeve, said outwardly turned surface having an outer diameter smaller than the inner diameter of the sleeve and being positioned therewithin, a reinforcement ring locked between said outwardly turned surface of the domed end wall and the seam connection thereadjacent, and said reinforcement ring being enclosed within a circumferentially extending channel formed between said outwardly turned surface of the end wall and the seam connection so as to lock the reinforcement ring axially and radially.

2. A pressure container as claimed in claim 1, wherein:

the reinforcement ring is part of a cylindrical sheet metal element protruding axially from the domed end wall, and said sheet metal element has one edge locked within the seam connection between the end wall and the cylindrical sleeve.

3. A pressure container comprising:

a cylindrical metal sleeve, an outwardly domed end wall, at least at one end of said sleeve, a seam connection between the outer end of said cylindrical metal sleeve and a flange of said outwardly domed end wall, said domed end wall having an outwardly turned surface, which adjacent to the seam connection, extends substantially parallel to the cylindrical sleeve, a reinforcement ring locked between said outwardly turned surface of the domed end wall and the seam connection thereadjacent, said reinforcement ring comprising a bead at one end of a cylindrical sheet metal element which protrudes axially from the domed end wall, and the end wall and the seam connection lock the reinforcement ring axially and radially.

4. A pressure container comprising:

a cylindrical metal sleeve, an outwardly domed end wall, at least at one end of said sleeve, a seam connection between the outer end of said cylindrical metal sleeve and a flange of said outwardly domed end wall, said domed end wall having an outwardly turned surface, which adjacent to the seam connection, extends substantially parallel to the cylindrical sleeve, a reinforcement ring locked between said outwardly turned surface of the domed end wall and the seam connection thereadjacent, the seam connection comprises an outwardly directed seam pressured radially inwardly so that its inner side face lies adjacent the outwardly turned surface of the domed end wall, the reinforcement ring is axially inward of the seam and completely enclosed by the material of the end wall, and the end wall and the seam connection lock the reinforcement ring axially and radially.

5. A pressure container comprising:

a cylindrical metal sleeve, an outwardly domed end wall, at least at one end of said sleeve, a seam connection between the outer end of said cylindrical metal sleeve and a flange of said outwardly domed end wall, said seam connection comprising an inwardly turned seam, said domed end wall having an outwardly turned surface, which adjacent to the seam connection, extends substantially parallel to the cylindrical sleeve, a reinforcement ring locked between said outwardly turned surface of the domed end wall and the seam connection thereadjacent, said reinforcement ring being enclosed axially between the seam and the domed end wall, and the end wall and the seam connection lock the reinforcement ring axially and radially.

* * * * *